US009689634B2

(12) United States Patent
Cassady

(10) Patent No.: US 9,689,634 B2
(45) **Date of Patent: *Jun. 27, 2017**

(54) FIREARM MAGAZINE SECURING APPARATUS, METHOD AND KIT

(71) Applicant: John Cassady, Fullerton, CA (US)

(72) Inventor: John Cassady, Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/990,466

(22) Filed: Jan. 7, 2016

(65) Prior Publication Data

US 2016/0223279 A1 Aug. 4, 2016

Related U.S. Application Data

(63) Continuation of application No. 13/974,280, filed on Aug. 23, 2013, now Pat. No. 9,234,715.

(51) Int. Cl.
*F41A 17/38* (2006.01)
*F41A 9/61* (2006.01)

(52) U.S. Cl.
CPC ..... *F41A 17/38* (2013.01); *F41A 9/61* (2013.01)

(58) Field of Classification Search
CPC .... F41A 9/61; F41A 9/65; F41A 17/00; F41A 17/34; F41A 17/38
USPC ..... 42/49.01, 6, 50, 16, 18, 70.02
See application file for complete search history.

(56) References Cited

U.S. PATENT DOCUMENTS 4,615,134 A * 10/1986 Beretta ..... F41A 35/06 42/6
5,519,954 A * 5/1996 Garrett ..... F41A 35/06 42/6
5,782,028 A * 7/1998 Simon ..... F41A 17/20 42/70.08
6,032,396 A * 3/2000 Shapiro ..... F41A 17/46 42/70.01
6,070,352 A * 6/2000 Daigle ..... F41A 11/02 42/49.02
6,154,996 A * 12/2000 Andreassen ..... F41A 17/44 42/70.11
6,173,519 B1 * 1/2001 Garrett ..... F41A 17/38 42/70.01
7,219,462 B2 * 5/2007 Finn ..... F41A 17/38 42/49.01
7,661,219 B1 * 2/2010 Knight, Jr. ..... F41A 3/42 42/17
7,921,587 B2 * 4/2011 Mayberry ..... F41A 21/481 42/49.01
8,327,749 B2 * 12/2012 Underwood ..... F41A 9/59 42/18
8,756,845 B2 * 6/2014 Harris ..... F41A 9/64 42/16

(Continued)

*Primary Examiner* — Jonathan C Weber
(74) *Attorney, Agent, or Firm* — The Law Office of Austin Bonderer, PC; Austin Bonderer

(57) ABSTRACT

A device for converting a firearm to a fixed magazine is disclosed. The device includes a magazine catch member having a through hole, and a one way threaded member comprising a threaded section and a head. The threaded section is able to pass through the through hole, and the head is configured so that a screw driver is only able to rotate the one way threaded member in a tightening direction. A kit for enabling a user to fix the magazine is also disclosed. A method for loading a magazine having a fixed magazine is also disclosed.

14 Claims, 7 Drawing Sheets

(56) References Cited

U.S. PATENT DOCUMENTS

| | | | | |
|---|---|---|---|---|
| 2001/0032407 | A1* | 10/2001 | Cain | F41A 17/063 42/70.11 |
| 2004/0020092 | A1* | 2/2004 | Christensen | F41A 9/70 42/49.01 |
| 2005/0183310 | A1* | 8/2005 | Finn | F41A 17/38 42/49.01 |
| 2006/0123683 | A1* | 6/2006 | Garrett | F41A 17/38 42/6 |
| 2010/0281736 | A1* | 11/2010 | Mayberry | F41A 21/481 42/49.01 |
| 2011/0056107 | A1* | 3/2011 | Underwood | F41A 9/59 42/18 |
| 2012/0198742 | A1* | 8/2012 | Troy | F41A 17/38 42/6 |
| 2013/0152442 | A1* | 6/2013 | Underwood | F41A 9/59 42/6 |
| 2013/0227869 | A1* | 9/2013 | Thordsen | F41C 27/00 42/6 |
| 2013/0269232 | A1* | 10/2013 | Harris | F41A 17/38 42/49.01 |
| 2014/0053444 | A1* | 2/2014 | Garrett | F41A 17/38 42/6 |
| 2014/0165439 | A1* | 6/2014 | Fernandez | F41A 17/38 42/6 |
| 2014/0223790 | A1* | 8/2014 | Wilson | F41A 9/65 42/49.01 |

* cited by examiner

FIREARM MAGAZINE SECURING APPARATUS, METHOD AND KIT

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION OF THE DRAWINGS

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
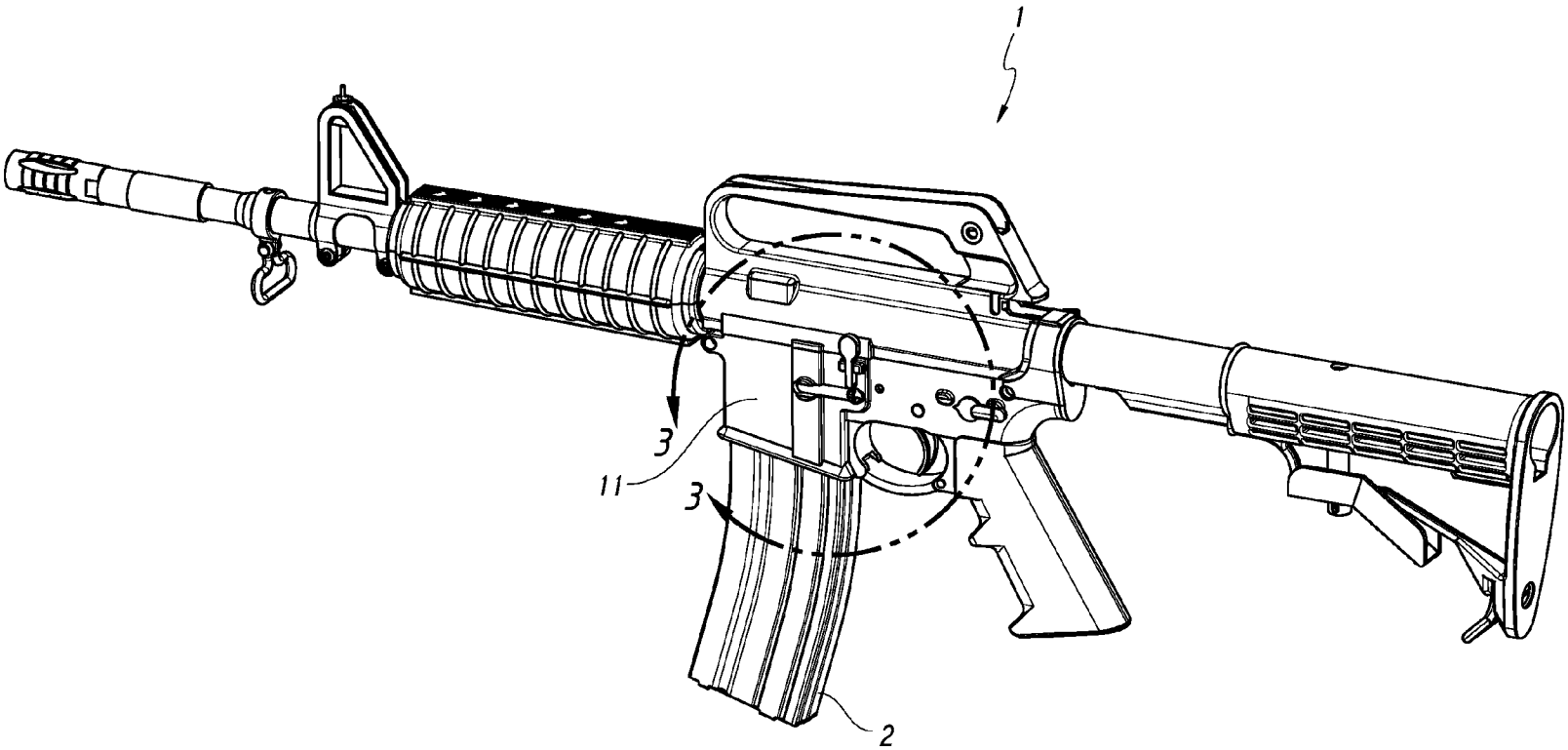
FIG. 1 shows an AR-15 platform with an embodiment of a magazine catch member and a one way threaded member.
Figure 2:
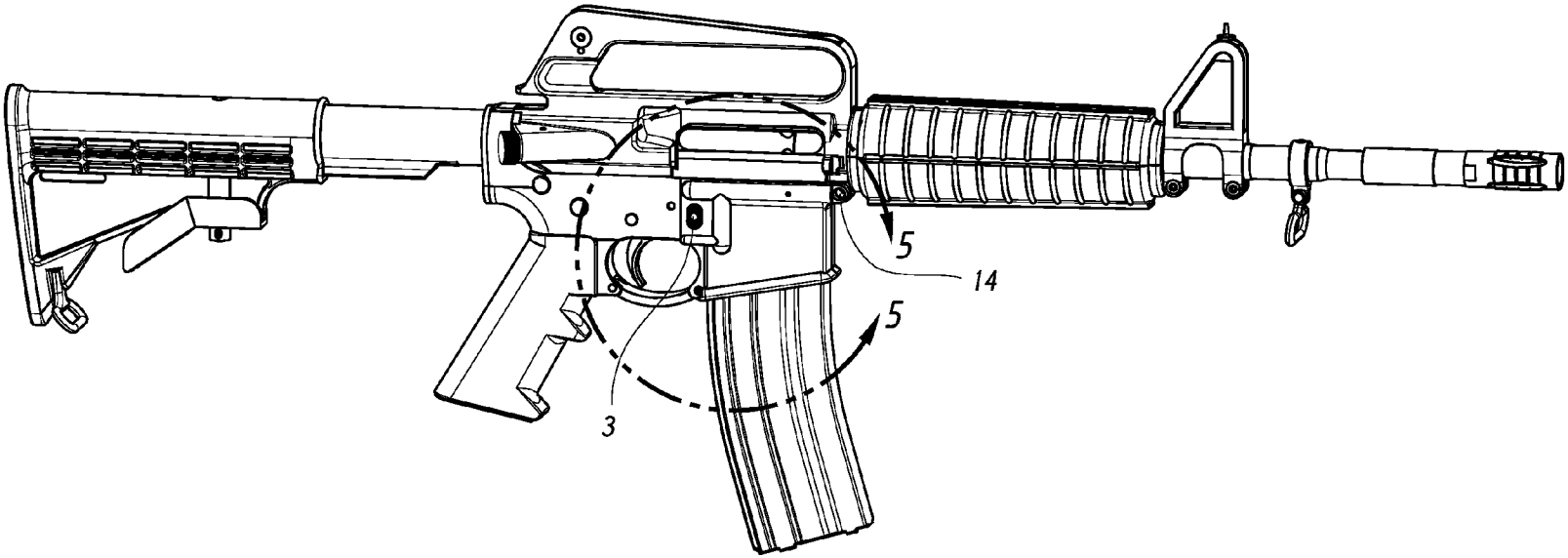
FIG. 2 shows another view of the AR-15 platform.

Referring to FIGS. 1 and 2, a firearm 1 is shown. While the drawings show an AR-15 platform, it is understood that any firearm 1 with a detachable magazine 2, a magazine catch button 3 and a magazine catch can be used. It is understood that platforms may differ in certain respects and name of parts, however the methods and parts used are easily adaptable to these platforms. As with most rifles, a magazine 2 is retained in the receiver 11, also known as a lower for some firearms 1, by a magazine catch. Multiple rounds of ammunition can be secured and fed by the magazine 2 into the chamber. Once the magazine 2 is empty, a user will typically press a magazine catch button 3, which will in turn actuate the magazine catch. Actuation of the magazine catch will push the magazine catch away from the receiver, and it will disengage the magazine. This will then release the magazine 2 and allow magazine 2 to be withdrawn from the receiver 11 and either replaced with another magazine 2 or the reloaded magazine 2. This mechanism allows for quick reloading of the firearm 1.

Figure 4:
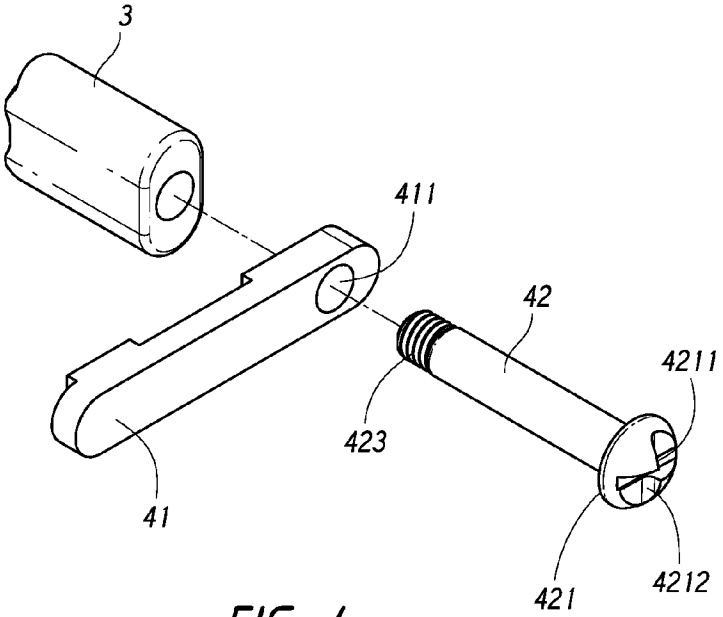
FIG. 4 shows an embodiment of a magazine catch button, a magazine catch member, and a one way threaded member.
Figure 3:
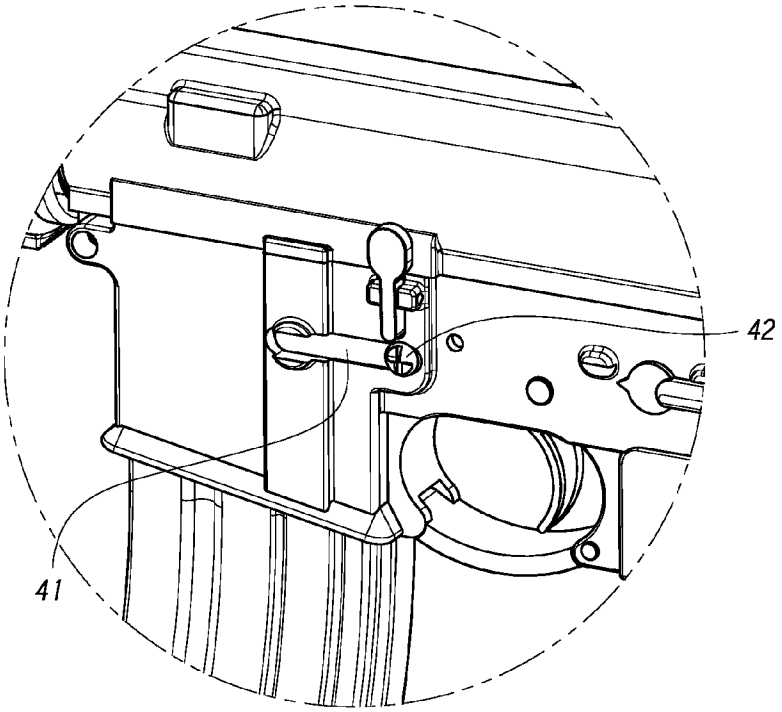
FIG. 3 shows an exploded view of FIG. 1.
Figure 5:
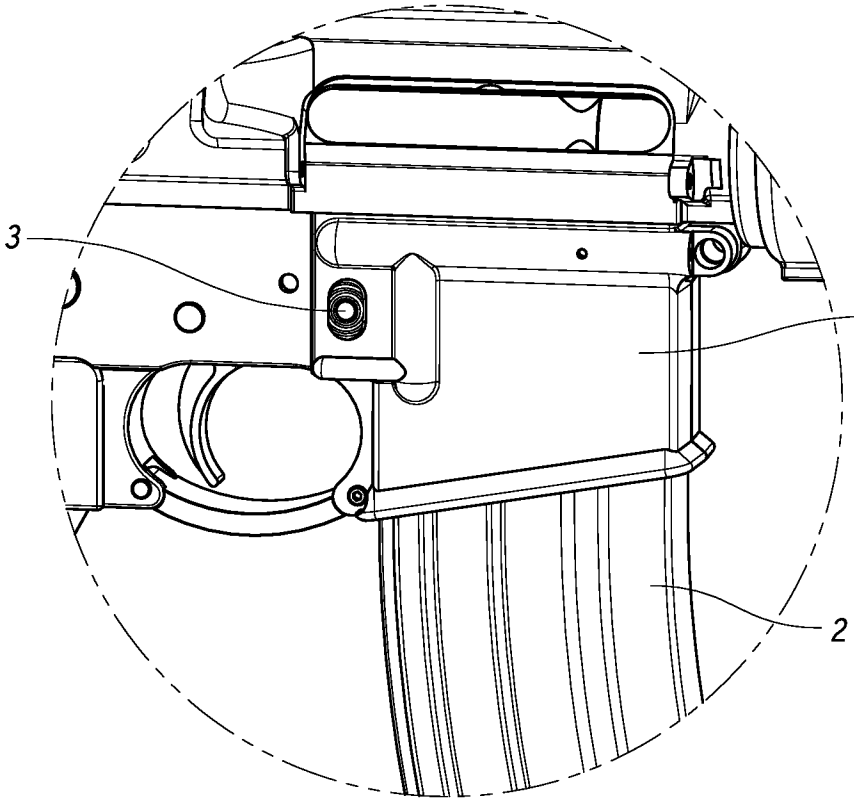
FIG. 5 shows an exploded view of FIG. 2; shows an embodiment of the magazine catch button.

Referring to FIGS. 3-5, an embodiment can bee seen. The magazine catch is shown comprising a magazine catch member 41 and a one way threaded member 42. In some embodiments, the one way threaded member 42 will have a threaded section 423 that corresponds to a stock magazine catch button 3. In use, the user will remove the stock magazine catch and replace it with the magazine catch member 41 and the one way threaded member 42. The one way threaded member 42 comprises a head 421 and a threaded section 423. The head 421 is designed such that a screw driver can engage the head 421 when rotating in the tightening direction. When trying to rotate the one way threaded member 42 in the loosening direction, the screwdriver will slip up the sloped surface 4212 and be unable to establish rotation. Thus once the one way threaded member 42 is fully screwed into the magazine catch button 3, a user will not be able to easily remove the magazine 2 from the receiver 11. There will be no room for actuation of the magazine catch button 3 as it will be permanently engaged with the receiver 11. This will secure the magazine in the receiver 11. It is understood that other known threaded members that are designed not to be removed can be substituted for the one way threaded member 42 as described.

In some embodiments, the head 421 has two abutment faces 4211 and two sloped surfaces 4212. Thus when the screwdriver rotates in the tightening direction, the screw driver abuts the abutment faces 4211 and rotates the one way threaded member 42. When the screw driver is rotated in the opposite direction, it slips up the sloped surfaces 4212 and off the head 421. Thus, one is only able to insert the one way threaded member 42 with a screw driver. If one were to want to remove the one way threaded member 42, a means other than a screwdriver would need to be employed.

Figure 6:
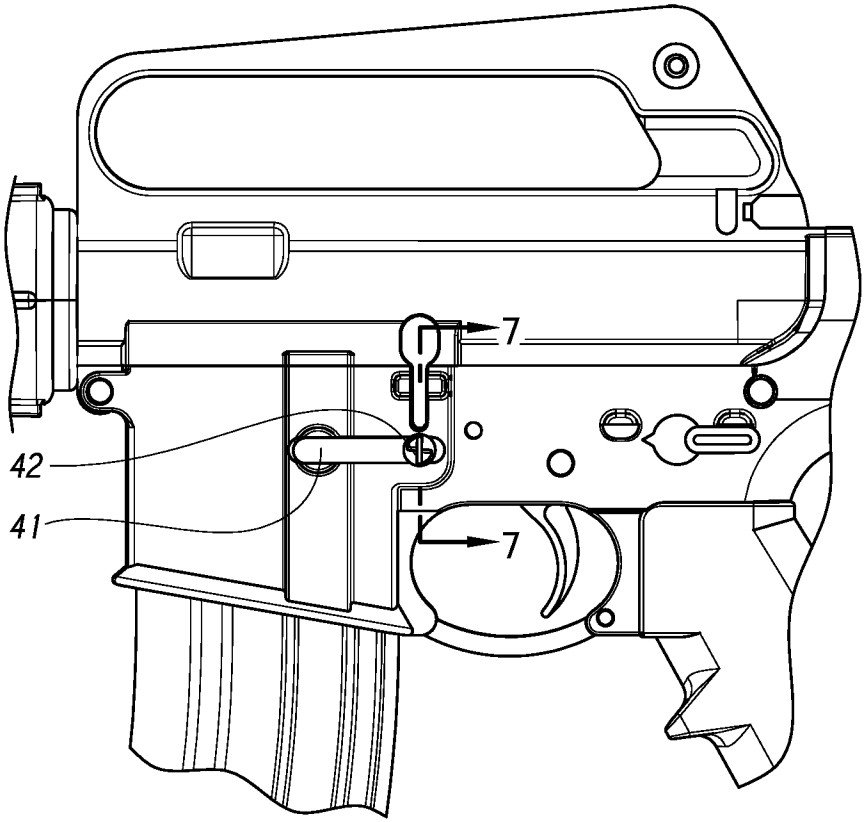
FIG. 6 shows an embodiment of one way threaded member and the magazine catch member.
Figure 8:
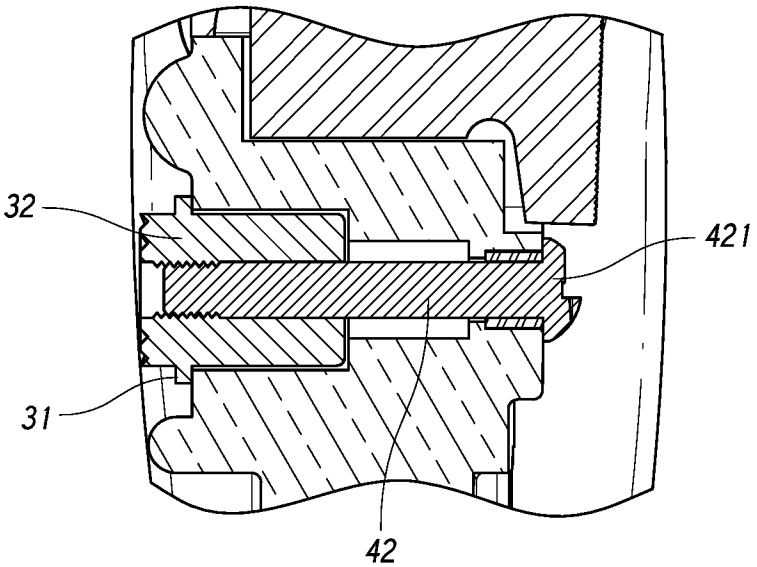
FIG. 8 shows another embodiment of the magazine catch button.
Figure 7:
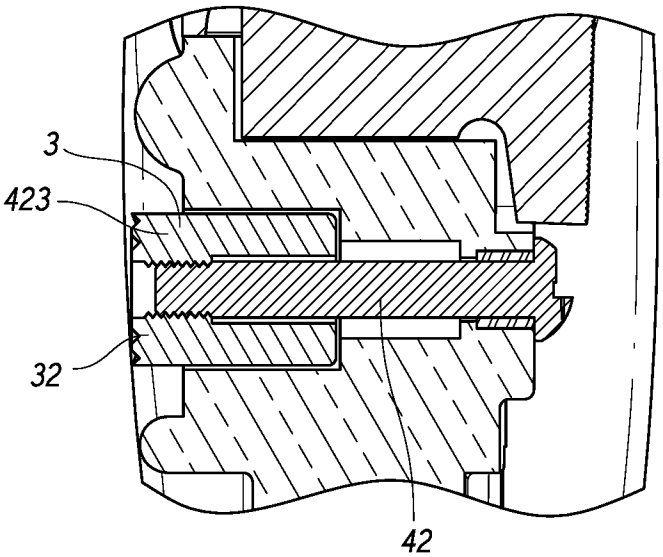
FIG. 7 shows an embodiment of a magazine catch member and a one way threaded member.

As shown in FIGS. 6-8, embodiments of the magazine catch button 3, when threadedly secured with the one way threaded member 42, are secured against the receiver 11. In FIG. 7, the magazine catch button 3 abuts the receiver 11 at the magazine catch button base 32. In FIG. 8, in another embodiment, a magazine catch button protrusion 31 and/or the magazine catch button base 32 abut the receiver 11. By being in an abutting relationship, there is no room to actuate the magazine catch button 3. Thus there is no room to move the magazine catch member 41 away from the receiver 11 to release the magazine 2.

Additionally as shown in FIGS. 4, 7 and 8, in some embodiments, the magazine catch member 41 comprises a through hole 411, and there is a sliding relationship between the magazine catch member 41 and the one way threaded member 42 extending through the through hole 411. Thus in these embodiments, even if there is limited movement, it does not mean that the actuation of the one way threaded member 42 will result in movement of the magazine catch member 41. In other embodiments, the magazine catch member 41 can be secured to the one way threaded member 42.

The effect of applying the device to a firearm 1 is that it is no longer easy to remove the magazine 2 from the receiver 11. It is a fixed attachment that would require some sort of machining and the replacement of parts to make the firearm 1 have a releasable magazine 2. On some platforms, one would be able to remove the magazine by breaking down the firearm 1 and rotating the one way threaded member 42 by some means (e.g. needle-nose pliers). In some embodiments, the one way threaded member 42 may have squared cross-section called a squared section 422. A small tool (e.g. a wrench) will be able to engage and cause a loosening rotation of the one way threaded member 42. It is understood that not all firearms 1 will allow access to the one way threaded member 42; however some will.

Another way to remove a one way threaded member 42 is to bore out the one way threaded member 42 with a drill or some other tool. The one way threaded member 42 can comprise of metal, ceramics, plastics, wood, alloys and combinations thereof. In some embodiments, the one way threaded member 42 is made of a material that is softer than a metal drill bit. The material will be firm enough so that when in normal use, it will maintain the magazine catch button 3 and the magazine catch member 41 in place. However, the material may be bored out by a drill bit. Thus if the magazine 2 ever become defective, the user can remove the one way threaded member 42 with a drill, replace the magazine 2 and insert a new one way threaded member 42. This will enable repair of the firearm 1. It will also allow the user to return the firearm 1 to normal configurations if they move to another jurisdiction and/or wish to do so.

Figure 9:
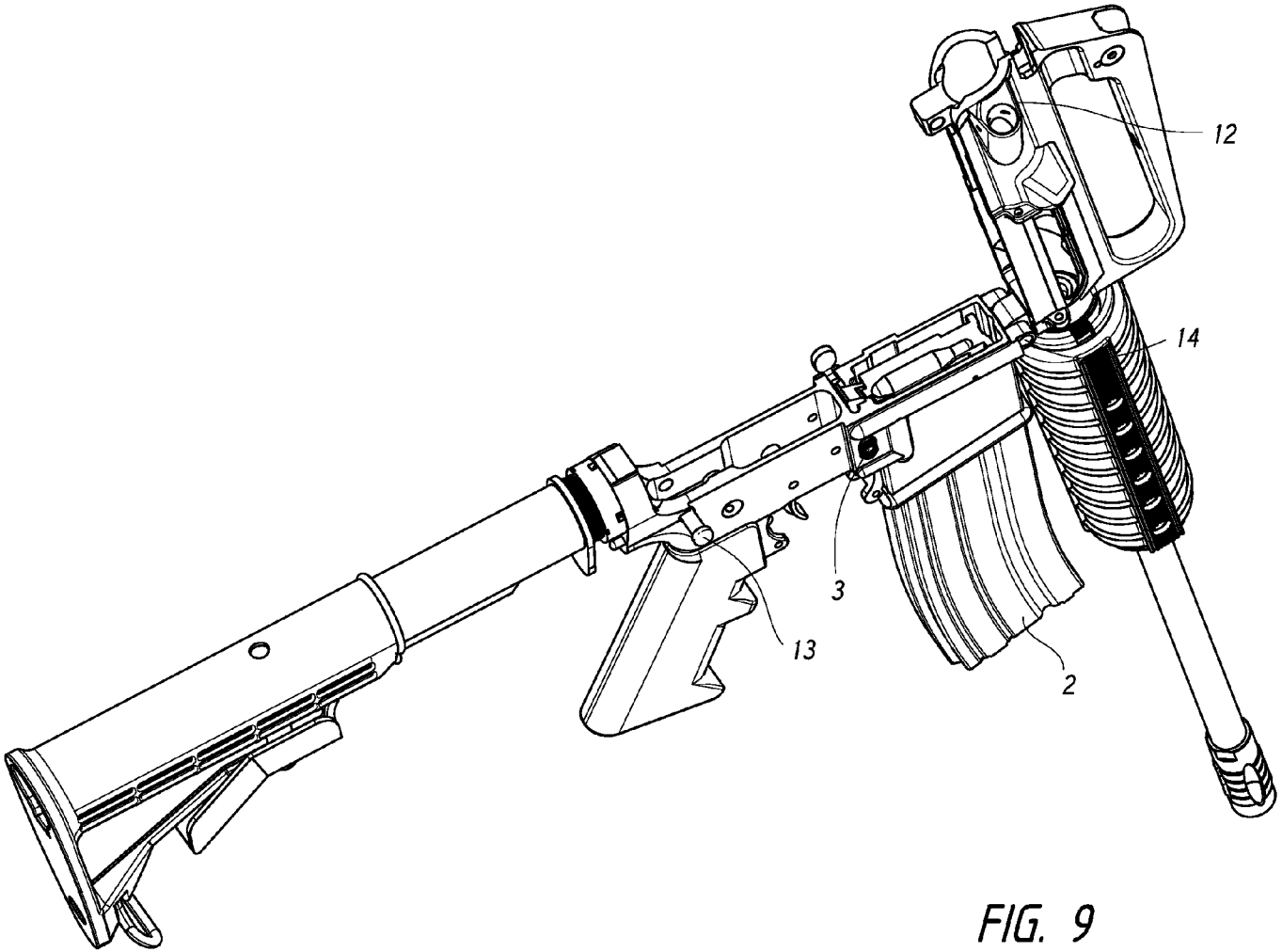
FIG. 9 shows an AR-15 in a partially broken down position with access to the magazine.

As seen in FIG. 9, to load the firearm 1, the user would have to at least partially breakdown the firearm 1 and load the ammunition in the magazine 2 through the receiver 11. This will greatly increase the amount of time that one would need to reload the firearm 1. It will also convert the firearm 1 to a fixed magazine firearm 1. This typically would place the firearm 1 in a different classification in terms of many jurisdictions. For example, if this was applied to an AR-15 as shown, in many states it would may no longer be classified as an 'Assault Weapon', and then it is free from the restrictions thereof. Obviously a user must comply with all local rules.

The magazine catch member 41 and the one way threaded member 42 can be sold as a kit. The kit can be specifically designed to work with a certain platform. Examples of platforms, but not limited to, include the AR-15, M-4, and AK-47. In some embodiments, the kit will include a magazine catch button 3. In some embodiments, a takedown pin 13 will be included. In some embodiments, the takedown pin 13 will have a handle to enable a user to actuate the takedown pin 13 without the use of a tool. Some embodiments of the kit will include a wrench that corresponds to the square section of the one way threaded member 42.

A method for securing a magazine 2 to a firearm 1 comprises one or more of the following steps:

S1 breakdown the firearm 1 by some degree;

S2 remove the Original Equipment Manufactured (OEM) magazine catch;

S3 install a magazine catch member 41; and

S4 secure the one way threaded member 42 to a magazine catch button 3 such that the magazine catch member 41 engages the magazine 2 so that it cannot be removed from the receiver 11.

The magazine should be inserted in the receiver 11 prior to S3. Additionally, either the OEM magazine catch button 3 or a different magazine catch button 3 can be used. Use of the OEM catch button 3 will typically result in the OEM catch button 3 being secured in the a recess and no longer exposed.

A method for loading a weapon having a secured magazine 2 comprises one or more of the following steps:

L1 move the takedown pin 13 to a degree to allow the upper 12 to rotate about the pivot pin 14;

L2 rotate the upper 12 to expose the entrance of the magazine;

L3 place ammunition in the magazine 2; and

L4 return the upper 12 to a closed position and secure the upper 12 to the receiver 11 with the takedown pin 13.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and the arrangement of parts within the principles of the disclosure, to the full extent indicated by the broad general meaning of the terms in which the appended claims are expressed.

It is also to be understood that the above description and the claims drawn to a method may include some indication in reference to certain steps. However, the indication used is only to be viewed for identification purposes and not as a suggestion as to an order for the steps.

What is claimed is:

1. An apparatus comprising:

a receiver;

a magazine catch button comprising a user interface end and a distal end;

a magazine catch member comprising a through hole; and a one way threaded member comprising a threaded section and a head;

wherein the threaded section is able to pass through the through hole, and the head is configured so that a driver is only able to rotate the one way threaded member in a tightening direction; the one way threaded member extends into the receiver and is engaged with the magazine catch button; both the magazine catch member and the distal end directly abut the receiver therebetween, such that there is no significant relative movement possible between the magazine catch member and the receiver.

2. The apparatus of claim 1, wherein the one way threaded member comprises a material that is selected from the group consisting of metal, ceramics, plastics, wood, alloys, and combinations thereof.

3. The apparatus of claim 1, wherein the magazine catch button comprises a section that corresponds to the threaded section.

4. The apparatus of claim 1, wherein the one way threaded member and the magazine catch member are separate.

5. The apparatus of claim 1, wherein the one way threaded member extends into the receiver and is engaged with the magazine catch button; and the magazine catch button abuts the receiver.

6. The apparatus of claim 5, wherein the magazine catch button comprises a flange.

7. The apparatus of claim 5, wherein the magazine catch button has consistent perimeter length.

8. The apparatus of claim 5, further comprising a magazine partially located in the receiver and the magazine catch member prevents the magazine from being removed from the receiver.

9. The apparatus of claim 1, further comprising a firearm, the firearm comprises the receiver and the firearm is an AR-15 platform.

10. A method comprising:

removing a magazine catch;

installing a magazine catch member; and securing a one way threaded member to a magazine catch button, comprising a user interface end and a distal end, such that both the distal end and the magazine catch member directly abut the receiver therebetween and the magazine catch member engages a magazine;

wherein when the distal end and the magazine catch member sandwich the receiver therebetween, removing the magazine from the receiver is not possible.

11. The method of claim 10, further comprising inserting the magazine into the receiver.

12. The method of claim 10, further comprising:

moving a takedown pin to a degree to allow the upper to rotate about a pivot pin;

rotating the upper to expose an entrance of the magazine; and placing ammunition in the magazine through the receiver.

13. The method of claim 12, further comprising returning the upper to a closed position; and securing the upper to the receiver with the takedown pin.

14. The method of claim 10, wherein the securing the one way threaded member to the magazine catch button comprises rotating the one way treaded member until it is fully received in the magazine catch button and a distance between the magazine catch button and the magazine catch member is fixed.

* * * * *